US005900603A

United States Patent [19]

Brush

[11] Patent Number: 5,900,603

[45] Date of Patent: May 4, 1999

[54] SEAL ARRANGEMENT FOR A SWITCH ASSEMBLY

[75] Inventor: Jeff A. Brush, Dunlap, Ill.

[73] Assignee: Caterpillar Inc., Peoria, Ill.

[21] Appl. No.: 08/984,259

[22] Filed: Dec. 3, 1997

[51] Int. Cl.[6] ..... H01H 19/06

[52] U.S. Cl. ..... 200/302.3; 200/293.1; 200/302.2; 74/553

[58] Field of Search ..... 200/302.2, 302.3, 200/293.1; 74/553

[56] References Cited

U.S. PATENT DOCUMENTS

| | | | |
|---|---|---|---|
| 3,654,415 | 4/1972 | Hawkins et al. | 200/168 G |
| 4,152,563 | 5/1979 | Bongort | 200/157 |
| 5,500,496 | 3/1996 | Venzke et al. | 200/339 |
| 5,510,589 | 4/1996 | Arnal | 200/522 |

*Primary Examiner*—Lincoln Donovan
*Assistant Examiner*—Lee S. Lum
*Attorney, Agent, or Firm*—William C. Perry

[57] ABSTRACT

Control levers have utilized various switch assemblies mounted within the grasping portion thereof to control multiple machine functions. The mounting of the switch assembly within the control lever typically provides an opening in the control lever that is somewhat larger that the switch assembly to accommodate relative movement therebetween. In many instances problems have been encountered because foreign matter is allowed to enter the interior of the control handle through a space that exists between the switch and the control lever. The present invention provides a seal plate between the a switch member and a cover member defined by the control lever. The seal plate is positioned about the switch member to cover the opening between the switch member and the cover member. The seal plate is continually biased into engagement within a relieved portion defined on an interior surface of the cover member by an abutment portion defined by the switch member during the full range of movement of the switch member.

6 Claims, 1 Drawing Sheet

SEAL ARRANGEMENT FOR A SWITCH ASSEMBLY

TECHNICAL FIELD

This invention relates to a switch assembly and more particularly to a seal arrangement between the switch assembly and the housing in which it is mounted.

BACKGROUND ART

In the operation of machines of all kinds, but in particularly construction machines, it has been common to include one or more switch assemblies into the grasping portion of the levers used to control the machine and its many implements. In doing so, accommodation must be made to accept various types of switches as well as the relative motion that may exist between the grasping portion of the lever and the actuator of the switch. In many situations, the opening in the grasping portion through which the switch actuator must extend must be larger than the body of the actuator to accommodate for this motion. Many times this opening or a cavity is large enough to allow a substantial amount of debris and foreign matter to gain access to an interior portion of the control lever. In many situations, the switch is intended to actuate an electronic mechanism. The foreign matter that has been allowed access to the interior of the control lever has been known to accumulate on the electronic switch components and interfere with performance of the control mechanism.

The present invention is directed to overcoming one or more of the problems set forth above.

DISCLOSURE OF THE INVENTION

In one aspect of the present invention, a switch assembly is disclosed that includes a housing that has an opening formed therein. A cover member is included that also has an opening formed therein and a relieved portion that is defined about the opening on a first surface thereof. The cover member is mounted to the housing in a manner wherein it is positioned within the opening formed in the housing. A seal plate is included that also has an opening formed therein. The seal plate is configured for positioning within the relieved portion defined by the cover member. A switch member is provided that has a first portion and an abutment portion. The switch member is mounted within the housing for relative movement with respect to the housing with the first portion thereof positioned within the opening formed by the seal plate. The abutment portion of the switch member is engaged with the seal plate in a manner wherein the seal plate is urged into fixed engagement within the relieved portion.

With a switch assembly as set forth above, a seal plate may be incorporated into the switch assembly to seal any opening between the switch member and the housing in which it is mounted. The seal plate is made to fit into a recess formed in the back of the housing. The seal plate is urged into a fixed position by its engagement with the abutment portion of the switch member. In this manner, the seal plate will remain fixed during the full range of movement of the switch without allowing a variance in the gap that exists between the seal plate and the switch member. This arrangement provides a static seal without requiring any additional mounting components that are specifically dedicated to the positioning or securement of the seal plate. This in turn, improves the function of the switch assembly while requiring very little extra expense in both the manufacture or assembly of switch assembly components.

BEST MODE FOR CARRYING OUT THE INVENTION

Figure 1:
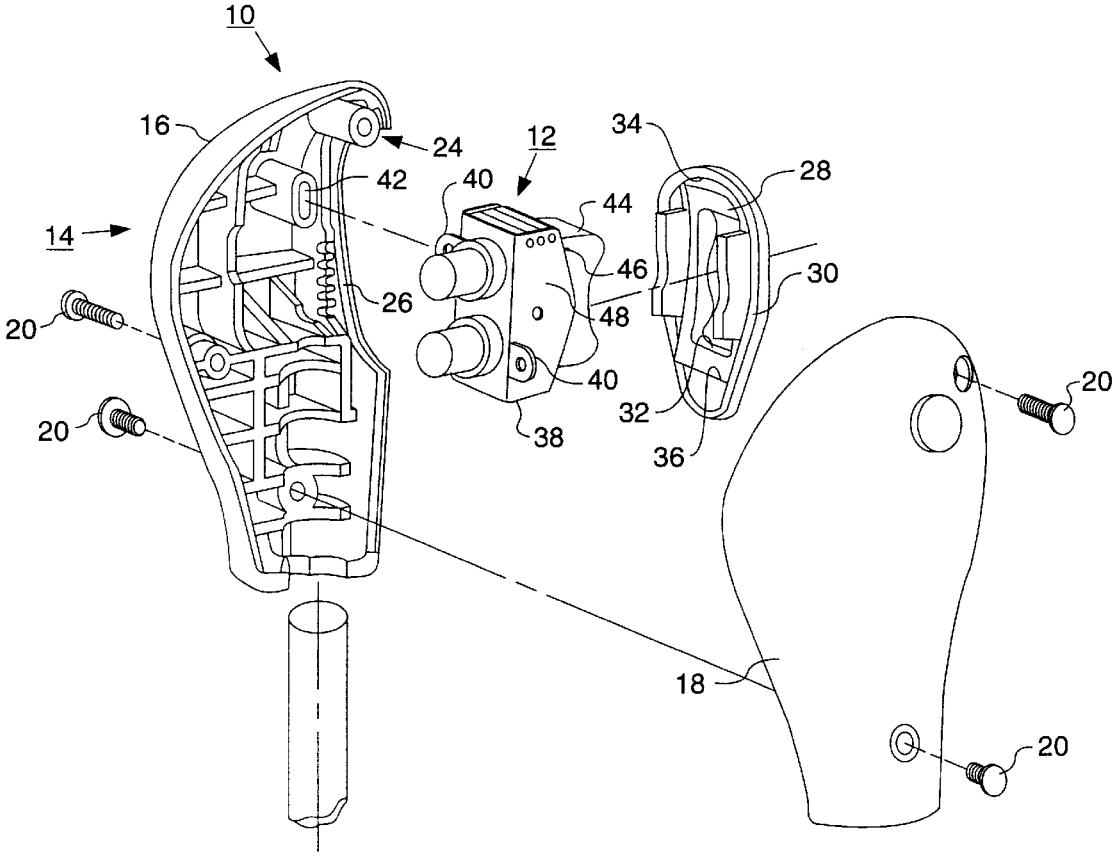
FIG. 1 is a diagrammatic exploded view of a control lever assembly that embodies the principles of the present invention.
Figure 2:
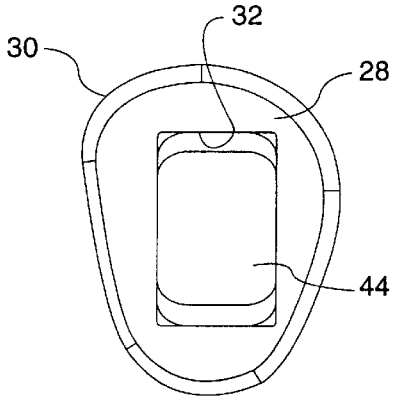
FIG. 2 is a diagrammatic front view of the switch assembly shown in FIG. 1.

Referring to the drawings, a control lever 10 is shown that incorporates a switch assembly, or switch member 12 therein. The control lever includes a grip assembly 14 that has first and second members, or halves 16 and 18 that are joined together along a generally central plane by a plurality of fasteners 20. The first and second members in their assembled condition, define a housing in which the switch assembly is secured. The control lever defines an opening 24 that is defined by a perimeter 26 of a preselected configuration.

A cover member 28 is provided that may accommodate one of various types of switch assemblies 12. The cover member 28 is a plate member that defines an outer periphery 30 that is complementary to the preselected configuration defined by the perimeter 26 of the opening 24 of the control lever 10. Since the respective perimeters 30 and 26 of the cover member 28 and the opening 24 defined in each half 16 and 18 of the grip assembly are complementary and their respective sizes are substantially equal, the switch assembly 12 is clamped in place within the opening 24 by the fasteners 20 as they in turn secure the first and second members 14 and 16 of the control lever to one another. The cover member 28 also defines an opening 32 in a generally central portion thereof. An interior surface 34 of the cover member 28 defines a generally rectangular relieved portion 36 therein in a region that bounds the opening 24.

Figure 3:
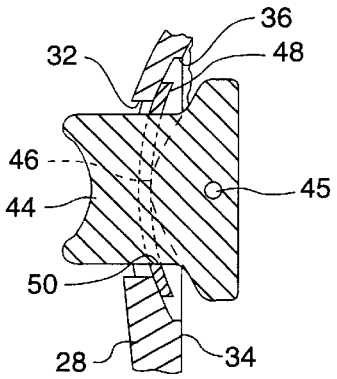
FIG. 3 is a diagrammatic section view taken along lines 3—3 of FIG. 2.

The switch member 12 has a pair of lateral extensions 40 that are received in sockets 42 (one of which is shown in FIG. 1) that are formed in the first and second members 16 and 18 of the control lever. The position of the switch member is fixed with respect to the assembled control lever and the cover member when in the assembled condition. The switch member has a first, or actuating member 44, that extends through the opening 24 in the cover member 28. The switch member 12 in the illustrated embodiment, is a three position switch and will move up and down about a pivot point 45 with respect to the cover member 28, as is best shown in FIG. 3. The switch member also defines an arcuate abutment portion 46 that is positioned adjacent the interior surface 34 of the cover plate. The arcuate abutment portion extends toward the opening 24 and is substantially centered with respect thereto.

A seal plate 48 is positioned between the switch member 12 and the cover member 28. The seal plate is generally rectangular in configuration and defines an opening 50 therethrough. The seal plate has a size that is slightly smaller than the relieved portion 36 defined by the cover member but is sufficient for movement within the confines thereof.

As can be seen in FIG. 3, the opening 50 defined by the seal plate 48 is just large enough to receive the actuating member 44 of the switch member 12. In the installed position shown in FIG. 3, the peripheral portions of the seal plate 48 are engaged with the relieved portion 36 of the cover member 28 while the central portion 52 thereof is engaged with the abutment portion 46 of the switch member 12. In this manner, engagement of the seal plate, which has a contour is essentially the same as that of the inner surface 34, with the cover member is maintained throughout the range of movement of the actuating member 44.

Industrial Applicability

In operation, the actuating member 44 extends outwardly from the cover member 28 to a location that may be engaged by an operator. The actuating member may be moved up or down with respect to the drawings about pivot 45 to one of three positions. As it moves, the distance between the actuating member and the upper and lower regions of the opening 24 in the cover member will change which requires the opening to be larger than the actuating member.

In order to seal the varying space between the opening 24 and the actuating member 44, the seal plate 48 is biased into engagement with the interior surface 34 of the cover member 28. Since the abutment portion 46 is arcuate in configuration, the seal plate is continually urged into engagement with the cover member during the full range of movement of the actuating member. In an uninstalled condition, when the seal plate is not engaged with the actuating member, it assumes a generally planer configuration, however since it is relatively thin in cross-section, as is shown in FIG. 3, it assumes the contour of the cover member. The seal plate remains sealingly engaged within the confines of the relieved portion 36 due to its continual engagement with the arcuate abutment portion 46 of the switch member.

Other aspects, objects and advantages of this invention can be obtained from a study of the drawings, the disclosure and the appended claims.

I claim:

1. A seal arrangement for a switch assembly, comprising:

a housing having an opening formed therein;

a cover member having at least one opening formed therein and a relieved portion defined about the opening on an interior surface thereof, said interior surface having a preselected contour, said cover member being adapted for portioning within the opening formed by the housing;

a seal plate having an opening formed therein and having a configuration sufficient for receipt within the relieved portion defined by the cover member; and a switch member having a first portion and an abutment portion having an arcuate engagement surface defined thereon, said switch member being mounted within the housing with the first portion positioned within the opening formed by the seal plate, said abutment portion engaged with the seal plate in a manner to urge the seal plate into fixed engagement within the relieved portion of the cover member wherein the seal plate assumes a shape that is complementary to that of the preselected contour of the relieved portion, said seal plate is adapted for sliding movement relative to the cover member in response to movement of the first portion relative to said cover member.

2. The seal arrangement as set forth in claim 1 wherein the housing is a gripping portion of a control lever assembly.

3. The seal arrangement as set forth in claim 1 wherein the switch member is mounted within the housing with the first portion thereof extending through the opening formed in the cover member, said opening being of sufficient size to accommodate the movement of the switch member with respect thereto.

4. The seal arrangement as set forth in claim 1 wherein the seal plate is substantially flat in configuration when not engaged with the abutment portion of the switch member and is deformed to a curvature as a result of the engagement with the abutment member of the switch member in an installed condition.

5. The seal arrangement as set forth in claim 1 wherein the opening defined in the seal plate is slightly larger in configuration than the first portion of the switch member and smaller than the opening defined by the cover member to substantially fill any void that exists between the switch member and the opening defined by the cover member.

6. The seal arrangement as set forth in claim 1 wherein the switch member is adapted for use with a control lever.

* * * * *

UNITED STATES PATENT AND TRADEMARK OFFICE

CERTIFICATE OF CORRECTION

PATENT NO. : 5,900,603

DATED : May 4, 1999

INVENTOR(S) : Jeff A. Brush

It is certified that error appears in the above-identified patent and that said Letters Patent is hereby corrected as shown below:

Column 3, line 41, delete "portioning" and insert --positioning--

Signed and Sealed this

Fifteenth Day of August, 2000

*Attest:*

*Attesting Officer*

Q. TODD DICKINSON

*Director of Patents and Trademarks*